US005236201A

United States Patent [19]

Vance, Sr. et al.

[11] Patent Number: 5,236,201

[45] Date of Patent: Aug. 17, 1993

[54] REINFORCEMENT STRUCTURE FOR INFLATABLE DOWNHOLE PACKERS

[76] Inventors: James C. Vance, Sr., 8765 Jackson Creek Rd., Sedalia, Colo. 80135; Roy G. Quinlan, 7376 S. Bannock Dr., Littleton, Colo. 80120

[21] Appl. No.: 970,522

[22] Filed: Nov. 2, 1992

Related U.S. Application Data

[63] Continuation of Ser. No. 784,336, Oct. 29, 1991, abandoned.

[51] Int. Cl.[5] ..... F16J 15/46

[52] U.S. Cl. ..... 277/34; 166/187

[58] Field of Search ..... 277/34, 34.6; 166/187; 138/129

[56] References Cited

U.S. PATENT DOCUMENTS

| | | | |
|---|---|---|---|
| 2,643,722 | 6/1953 | Lynes et al. | 277/34.6 |
| 2,872,230 | 2/1959 | Desbrandes | 166/187 |
| 2,970,651 | 2/1961 | Roberts | 166/212 |
| 3,028,915 | 4/1962 | Jennings | 166/187 X |
| 3,035,639 | 5/1962 | Brown et al. | 166/187 X |
| 3,905,399 | 9/1975 | Dunnet | 138/129 |
| 4,191,383 | 3/1980 | Baker et al. | 277/34.6 X |
| 4,614,346 | 9/1986 | Ito | 166/187 |
| 4,700,954 | 10/1987 | Fischer | 277/227 X |

*Primary Examiner*—William A. Cuchlinski, Jr.
*Assistant Examiner*—Scott W. Cummings
*Attorney, Agent, or Firm*—J. L. Isaac; S. Austin; C. Castleman

[57] ABSTRACT

An inflatable packer includes an elastomeric tubular body adapted for radial expansion and having a longitudinal axis. An elastic outer cover surrounds the tubular body, and coupling members are disposed on each end of the tubular body. A plurality of reinforcing elements are sandwiched between the cover and the body and have end portions terminating at the coupling members. The reinforcement elements include spirally wound members extending the length of said body between the coupling members. The reinforcement elements are wrapped about the tubular body in a manner to continuously decrease the lay angle thereof relative to the longitudinal axis of the body from each coupling member toward the center portion of the tubular body.

26 Claims, 2 Drawing Sheets

REINFORCEMENT STRUCTURE FOR INFLATABLE DOWNHOLE PACKERS

This is a continuation of pending U.S. patent application Ser. No. 07/784,336 which was filed on Oct. 29, 1991 now abandoned.

BACKGROUND OF THE INVENTION

1. Field of the Invention

The present invention relates generally to an inflatable packer attached to a supporting element for sealing an annular space in a well bore and, more particularly, to an improved inflatable packer having higher pressure resistance. Specifically, the present invention relates to inflatable packers having improved reinforcement structure to prevent premature failure under high pressure conditions.

2. Description of the Prior Art

Inflatable packers are down-hole tools useful in the well drilling industry as well as in other piping applications. An inflatable packer is internally inflatable utilizing a fluid for the purpose of sealing off an annular space in the well or pipe, for example, between the casing and the well bore, or between a drill string or other retrievable tool and an outer well casing. Although not so limited, the packer of the present invention is particularly suited for isolating zones within a well for such purposes as cementing, fracturing, treating, testing, preventing gas migration to the surface and for gravel pack operations.

Inflatable packers normally include an elastomeric body and a reinforcement sheath or layer. The elastomeric tubular body is adapted for inflation such that the center portion extends radially outwardly to forcibly engage the well bore or well casing thereby positioning the packer in the well. Typically, the inflatable portion of the packer includes a center portion which is uniformly inflated so as to provide a collar or sleeve area engaged with the well bore. The ends of the packer have couplings to enable the packer to be attached to a drill string, and the area between the couplings and the center portion is a transition zone that is gradually expanded from the narrow non-expanded coupling to the fully expanded center portion.

Typically, the reinforcement elements or sheaths may include a plurality of strain-resistant elements or cords of high modulus that extend helically about the tubular body in one or more layers. These reinforcement elements are then clamped or in some other manner attached at their ends to the end couplings of the packer so as terminate at the end couplings. An example of one such arrangement is illustrated in U.S. Pat. No. 4,614,346. The angle that the reinforcement elements make relative to the longitudinal axis of the tubular elastomeric body is known as the lay angle inasmuch as this is the angle at which the helically wound elements are laid up around the uninflated tubular body. When the packer is inflated, the angle that the cords make relative to the longitudinal axis is known as the angle of equilibrium between the hoop tension and the axial tension of the cord, since it is at an angle to longitudinal axis. A specific, specialized equilibrium angle known in the hose art is known as the lock angle, i.e., 54° 40′, at which point the cords provide maximum reinforcement strength relative to radial expansion of the rubber hose.

Recognized problems with prior packers have been the inability to securely anchor reinforcing elements of the packer body to the end sleeve or coupling members during inflation due to the axial force created on the reinforcement members as the tube expands radially outwardly and the reinforcing members are stretched away from their coupling connections. In addition, there is a tendency for the reinforcing elements to separate from each other and permit elastomeric material to be pressured up between them, thereby providing weak spots in the reinforcement subject to pin hole leaks and eventual blow-outs at the expansion area of the packer. Again, U.S. Pat. No. 4,614,346 attempts to alleviate this problem by providing multiple layers of helically wound reinforcing elements, with each layer having alternate lay angle winds with respect to the packer axis. Examples of other prior art devices which attempt to alleviate the aforementioned problems include those disclosed in U.S. Pat. Nos. 2,643,722, 2,872,230, 2,970,651, 3,028,915, 3,035,639, 4,191,383, 4,700,954 and Canadian Patent No. 702,327.

Despite the numerous attempts to alleviate or at least reduce the aforementioned problems, there is still a need for an inflatable packer construction which reduces the problems of reinforcement element rupture at their juncture with the end couplings, the tendency of the elastomeric body of the packer to rupture or develop pin hole leaks, and the failure of the packer body to return substantially to its original uninflated configuration after repeated inflation/deflation cycles.

SUMMARY OF THE INVENTION

Accordingly, it is one object of the present invention to provide an inflatable packer with improved rupture resistance.

It is another object of the present invention to provide an improved inflatable packer capable of withstanding high internal inflation pressures and external differential pressures across the packer element.

Still another object of the present invention is to provide an inflatable packer which reduces differential hoop and axial stress on the reinforcing elements during inflation and deflation.

To achieve the foregoing and other objects and in accordance with a purpose of the present invention as embodied and broadly described herein, an inflatable packer is disclosed and includes an elastomeric tubular body adapted for radial expansion and having a longitudinal axis. An elastic outer cover surrounds the tubular body, and coupling members are disposed on each end of the tubular body. A plurality of reinforcing elements are sandwiched between the cover and the body and have end portions terminating at the coupling members. The reinforcement elements include spirally wound members extending the length of said body between the coupling members. The reinforcement elements are wrapped about the tubular body in a manner to continuously decrease the lay angle thereof relative to the longitudinal axis of the body from each coupling member toward the center portion of the tubular body.

BRIEF DESCRIPTION OF THE DRAWINGS

The accompanying drawings, which are incorporated in and form a part of a specification, illustrate preferred embodiments of the present invention and together with a description, serve to explain the principles of the invention. In the drawings.

DETAILED DESCRIPTION OF THE PREFERRED EMBODIMENTS

Figure 1:
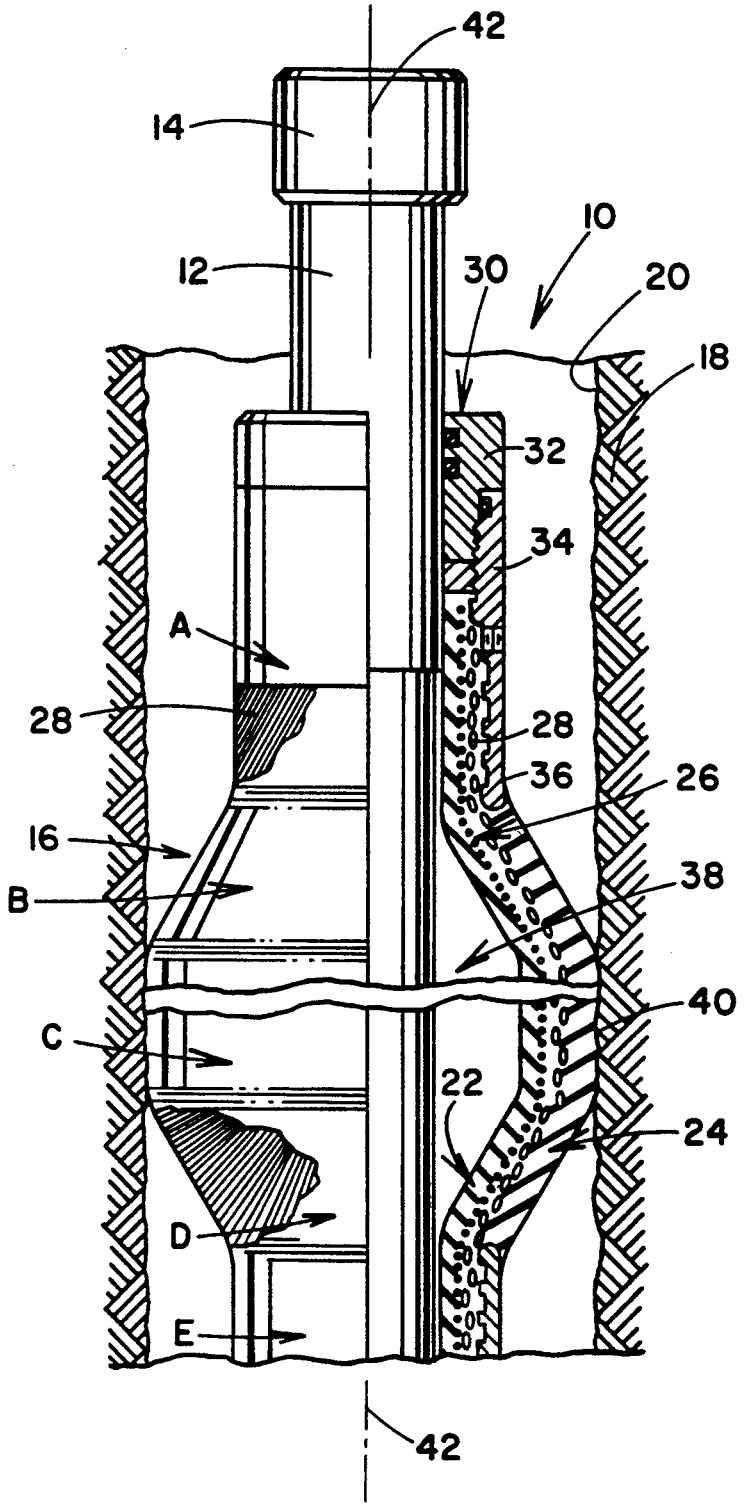
FIG. 1 (PRIOR ART)
FIG. 1 is a vertical sectional view, partially broken away, of a typical inflatable packer and tool assembly of the prior art shown inflated against a well bore.

Referring first to FIG. 1, a typical inflatable packer device 10 known to the art is illustrated. The packer assembly 10 includes an inner cylindrical mandrel 12 connected to a casing string 14 with the inflatable annular packer element 16 supported on the mandrel 12. Although this particular embodiment describes a casing type packer to seal against the well bore 18 having an inner bore surface 20 of a subterranean formation, the packer element 16 can alternatively be installed on a drill string, corresponding to the mandrel 12, located inside of a well casing for sealing the annular space therebetween.

In general, the packer element 16 includes an elastomeric tubular body or core 22, an outer elastic cover 24 preferably made from an abrasion resistant elastomeric material, and an annular reinforcement sheath or layer 26 preferably composed of individual reinforcement elements 28. The reinforcement elements 28 are sandwiched between the tubular body or core 22 and the outer cover 24. In a typical preferred embodiment of the invention, reinforcement sheath or layer 26 is formed from a plurality of such reinforcement elements 28 spirally wound around the tubular body 22, each of the elements 28 preferably being in the form of reinforcement cords or cables as described in more detail below.

In the embodiment illustrated in FIG. 1, the packer 16 is terminated at its end by a ferrule or end member 30 which includes an end cap 32 and an annular ring or sleeve 34 which is readily engagable with the end cap 32. Other end cap or coupling arrangements, however, may be utilized with the present invention. The annular ring or sleeve 34 is preferably affixed to the outer cover 24 at the interface 36 by the use of any standard typical attachment means such as epoxy resin and the like. Thus, the annular sleeve 34 of the ferrule 30 represents a rigid and unexpandable portion of the packer 16, this arrangement being repeated on both ends of the packer 16.

The packer illustrated in FIG. 1 is in its inflated state wherein pressured fluid is injected into the central portion 38 to expand the central portion 38 so that the outer surface 40 of the outer cover 24 is expanded and contacts the surface 20 of the well bore 18 and thus maintains the packer 16 in position within the well bore 18. To remove the packer 16 from the well bore 18, the pressurized fluid is removed from the central portion 38 so that the tubular body 22 and the outer cover 24 deflate to their original position in vertical alignment with the ferrule 30.

A major problem with previous packer designs is that repeated inflation and deflation of the central area 38 causes extreme and repeated pressures and forces at the juncture between the tubular body 22, the outer cover 24 and the ferrule 30. These forces also act on the anchoring mechanism of the reinforcement elements 28 at their terminal portions proximate the ferrule 30. Excessive pressure within this central zone 38 can increase the forces at this juncture to the point where the tubular body 22 and/or outer cover 24 ruptures, or where the reinforcement elements 28 are sufficiently stretched and subjected to sufficient axial stress so as to separate them from their anchoring position thereby rupturing the juncture between the ferrule 30 and the body 22 and cover 24.

Another problem with prior art designs is that as the central portion 38 is expanded, the reinforcement cords 28, which are typically helically wound at a common angle about the tube 22, are axially stretched as well as subjected to circumferential hoop stresses so as to change the angle of the reinforcement cords 28 relative to the longitudinal axis 42 in the center zone C as well as the transition portions or zones B and D, as compared to the lay angle of the cords 28 in the unexpanded zones A and E. FIG. 1 illustrates this clearly. The lay angle is the angle at which the reinforcement cord is "laid up" around the tube 22 and in prior art designs has been a uniform angle relative to the longitudinal axis of the tube 22. The prior art cords are therefore not laid up with as high an angle at the coupling. This gives more space between cords upon expansion. Furthermore, the cords are unstable when they come into equilibrium since they frequently are not locked. This reduces hoop strength and provides low rigidity. In addition, all the diameters of the cords change at the coupling, and this increases the tendency of the cords to pull out of the coupling. Finally, the changing of the lay angle tends to open space between the cords 28 and thereby reduce the amount of reinforcement about the elastomeric tube 22 at the point of maximum pressure, the center portion C. If the pressure is sufficient within the central zone 38, the tube 22 can rupture at these points or at least create pin hole type leaks. The present invention is designed to overcome the aforementioned problems.

Figure 2:
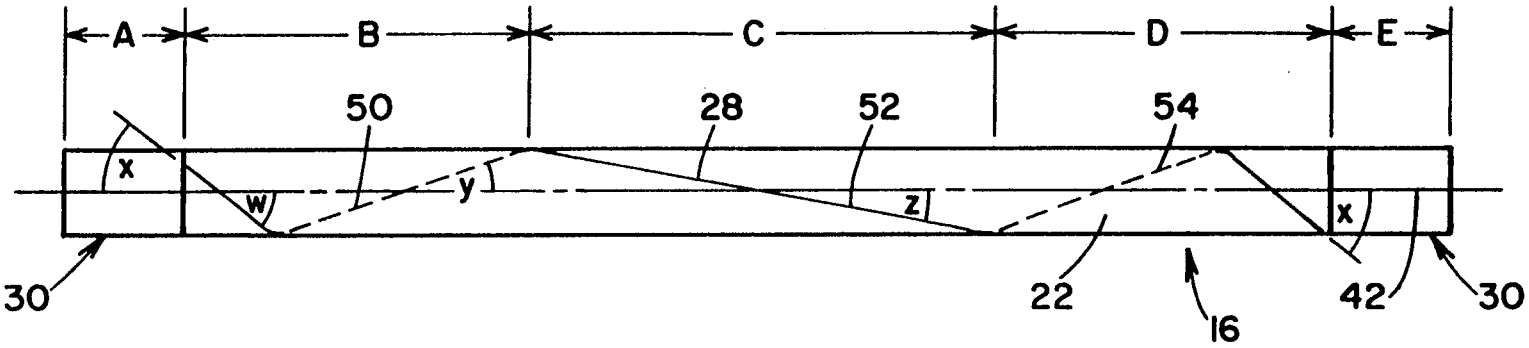
FIG. 2 is a schematic of an uninflated packer, partially constructed, illustrating the variable wind of one reinforcement element in accordance with the invention.
Figure 3:
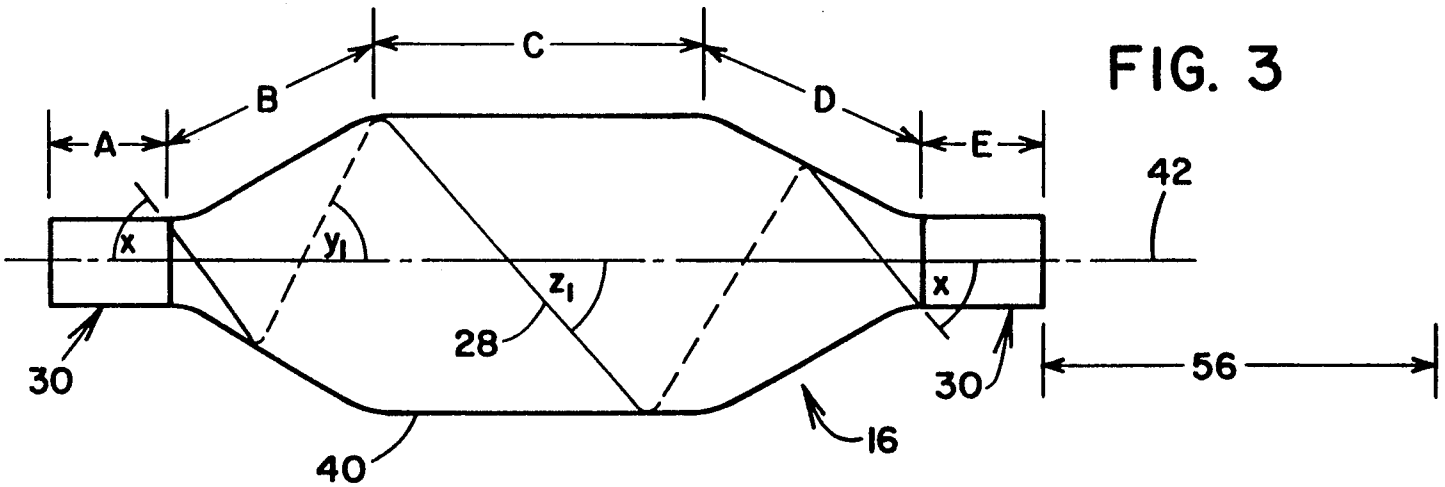
FIG. 3 is a schematic of the packer illustrated in FIG. 2 showing the packer in a fully inflated condition.

Turning now to FIGS. 2 and 3, the packer 16 is shown in its schematic form in an uninflated condition in FIG. 2 and an inflated condition in FIG. 3. In this particular illustration, only one reinforcement cord 28 is illustrated. However, it is to be understood that there are a plurality of reinforcement cords 28 wound in parallel fashion so as to form a layer of reinforcement cords or elements 28. Moreover, it is preferable to lay all the cords individually to thereby provide uniform tension. Likewise, there may be a plurality of such layers wound in similar fashion, one on top of the other separated by adhesive material or any other similar type of separation material.

As in the prior art embodiments, the cords 28 are wound about the tubular elastomeric body 22 in a helical-type fashion. In accordance with the present invention, however, the lay angle W is variable along the length of the tube 22 when the cord 28 is wound about the uninflated tube 22 from the coupling 30 to the center portion C. The lay angle X, which is the angle from which the cord 28 leaves the coupling 30, is preferably the equilibrium angle which will be achieved when the packer 16 is fully expanded. In one preferred form of the invention, this angle is preferably 43°-60° and may be the lock angle of 54° 40', although the angle X may reach as high as approximately 70° in certain constructions. The lay angle Y gradually diminishes as the cord moves along the transition zone B toward the center portion C. This arrangement is also reflected at the other end of the packer 10 when the cord 28 moves from the coupling portion E through the transition portion D to the center portion C.

When the reinforcement cord 28 reaches the center portion C, the lay angle Z remains constant throughout the center portion C. The lay angle Z is sized so as to reach the equilibrium angle X when the packer 16 is expanded as indicated in FIG. 3. Thus, the lay angle Z is preferably in the neighborhood of 12°-13° relative to the longitudinal axis 42 and may be as low as 10°. However, the specific angle Z may vary depending upon the specific size of the packer 16 and degree of expansion which it must go through upon inflation.

Referring particularly to FIG. 3, it can be seen that the lay angle W increases in the center portion C and the transition portions B and D during inflation of the packer 16. Therefore, the rate of lay angle decrease from the coupling 30 across the transition zones B and D to the center portion C, which is varied so that the cord 28 will reach a lay angle Z at the center portion C in such a manner that upon inflation of the packer 16, the lay angles X, $Y_1$ and $Z_1$ representing the lay angles in the zones A-E, B-D and C of the inflated packer, are all substantially equal. This angle is, in preferred form, the equilibrium angle wherein the hoop tension factor on the cord 28, which is the radial factor, and the axial tension factor on the cord 28, which is the longitudinal factor, are substantially equal based on the internal pressure of the packer 16. In this manner, the cord 28 will be positioned in the most favorable position to restrain the elastomer tube 22 and to prevent expansion separation of the cords 28 from each other as in prior packers. Since the equilibrium angle X, $Y_1$ and $Z_1$ are substantially equal throughout the entire length of the inflated packer 16, the reinforcement provided by the elements 28 will be evenly distributed to prevent point stress. Moreover, since the cords 28 continue to lay parallel and adjacent to each other during expansion, the present invention reduces the potential of the elastomer 22 from seeping between the cords 28 and providing a site for blowout. One can see the foreshortening 56 of the packer 16 upon inflation, and it is this foreshortening of the packer 16 which permits all the portions 50, 52 and 54 of the cord 28 to retain the same lay angle along the length of the inflatable packer 16.

The preferred rate of cord angle decrease across the transition zones B and D in geometric. In preferred form, the rate of angle decrease is based on the second order derivative of the cord angle per inch of tube. For example, when the lay angle X is 50°, one inch of winding across zone B will produce a lay angle Y of 41.6°, two inches will provide an angle of 37.8°, and the like. This particular preferred rate of decrease will provide packer 16 with an optimum expansion configuration to withstand pressure against it from above the coupling 30.

In the preferred embodiment, there are plurality of such cords 28 wrapped about the tubes 22 having variable lay angles. The cords 28 are laid down about the tubes 22 in parallel adjacent form so as to form an entire layer of reinforcement cords 28 surrounding the tube 22. As in prior art devices, these layers may be built one upon each other to provide additional reinforcement.

The above identified arrangement of the variable lay angle of the reinforcement cords 28 also enables the packer 16 to be inflated and deflated many times and still have the packer 16 returned to its original uninflated configuration after such repeated cycles. This is due to the fact that the uniform equilibrium angle that the cord 28 has along the length of the tube 22 when the packer 16 is inflated evenly distributes the reinforcement and pressure resistance and thus contributes to the return of the packer 16 to its original shape.

A further advantage of the arrangements described above is that the cords 28 have a higher retention factor at the coupling 30. In prior devices, there has been a tendency to have a very high axial stress force against the cord 28 when the packer was inflated due to the low lay angle of the cord relative to the coupling 30. In the present invention, the high angle X at the coupling 30 which is retained during inflation increases retention capability since it tends to pull down on the coupling and since it has a high hoop stress factor due to its large angle relative to longitudinal axis. In this manner, the cord 28 does not tend to be pulled or separated at its adhesion point with the coupling 30. Moreover, when the cord 28 is at its locked angle at the coupling 30, this prevents back bending and rolling lobe problem with the tube 22 and cover 24.

In one specific embodiment of the invention, a packer 16 was constructed wherein the packer element 16 was 66 inches long. In this particular embodiment, each transition zone B and C were ten inches in length, and the central zone or portion C was 32.34 inches in length. The original width of the packer member 16 was 3.3 in. in an uninflated state and expanded out to 8 in. in a fully inflated state. In this example, there were six plies of cords 28 each separated by an adhesive gum layer. In this instance, the transition lay angle Y decreased from 57° at angle X to 17° at angle Z. In another example similar to this, the transition angle Y decreased over the transition zones B and D from 50° at angle X to 12° at angle Z. In each of these instances, the equilibrium angle represented by the angle X was achieved upon full expansion of the packer 16.

It should be noted, however, that if the packer 16 is placed within a well 18 and the packer 16 fully expanded so that the central portion C contacts the well wall 20, and this expansion is less than the maximum expansion design for the packer 16, the angles $Y_1$ and $Z_1$ achieved by the cords 28 will be somewhat less than the equilibrium angle X since the packer 16 is being prevented from expanding to its fully designed state. However, the angles $Y_1$, $Z_1$ will nonetheless approach the equilibrium angle and thereby still evenly distribute the forces across the entire length of the tube 22 while keeping the cords 28 parallel and adjacent to each other.

As can be seen from the above, the present invention provides a number of advantages as compared to packer designs presently available in the art. The variable angle of the present invention enables the reinforcement cords to remain parallel and evenly spaced during inflation since the reinforcement cords 28 achieve substantially the same equilibrium angle at full expansion. This reduces the problem of separation of cords in the center expansion zone, which leads to pin hole leaks and eventual rupture. The present invention also reduces the axial stress on the cords at their junction with their end couplings thereby reducing the rupture tendency near the couplings by substantially inhibiting separation forces between the cords and the couplings. Finally, the present invention enables the packer to return to its original uninflated state after numerous cycles of inflation and deflation. The result of the above is that the present invention provides a packer which is substantially improved relative to its capability of withstanding high pressures and reducing rupture potential.

The foregoing description and the illustrative embodiments of the present invention have been shown in the drawings and described in detail in varying modifications and alternate embodiments. It should be understood, however, that the foregoing description of the invention is exemplary only, and that the scope of the invention is to be limited only to the claims as interpreted in view of the prior art. Moreover, the invention illustratively disclosed herein suitably may be practiced in the absence of any element which is not specifically disclosed herein.

We claim:

1. An inflatable packer comprising:

an elastomeric tubular body having an unexpanded state and adapted for radial expansion to an expanded state and having a longitudinal axis;

an elastic outer cover surrounding said tubular body;

coupling members disposed on each end of said tubular body, said tubular body including an expandable center portion and expansion transition portions disposed between said coupling members and said expandable center portion; and a plurality of reinforcing elements sandwiched between said cover and said body and having end portions terminating at said coupling members, said reinforcing elements including spirally wound reinforcing members forming a lay angle relative to the longitudinal axis extending the length of said body between said coupling members and wrapped about said tubular body in a manner to continuously decrease the lay angle thereof relative to said longitudinal axis from each said coupling member toward the center portion of said tubular body, the lay angle of said reinforcing members decreasing across each said transition portion so that when said tubular body is in its unexpanded state, the lay angle of said reinforcing members enable the formation of a substantially uniform equilibrium angle between said reinforcing members and the longitudinal axis throughout the entire length of said body between said coupling members when said tubular body is in its fully expanded state.

2. The packer as claimed in claim 1, wherein the lay angle of said reinforcing members decrease across each said transition portion at a rate effective to create said substantially uniform equilibrium angle up to a lock angle at which the cords provide maximum reinforcement relative to the expansion of the tubular body.

3. The packer as claimed in claim 1, wherein the lay angle of said reinforcing members relative to said longitudinal axis continuously decreases across each said transition portion between said coupling member and said center portion, and wherein said lay angle remains substantially constant in said center portion.

4. The packer as claimed in claim 3, wherein the lay angle of said reinforcing members decreases geometrically at a rate based on the second order derivative of the cord angle per inch of length of said tubular body across said transition portion.

5. The packer as claimed in claim 3, wherein the maximum lay angle of said reinforcing members at the junction of said coupling members is approximately 70° relative to said longitudinal axis, and the minimum lay angle of said reinforcing members in the center portion of said tubular body is approximately 10° relative to said longitudinal axis.

6. The packer as claimed in claim 5, wherein the lay angle of said reinforcing members at the junction of said coupling members is approximately 43°-60° relative to said longitudinal axis, and the lay angle of said reinforcing members in the center portion of said tubular body is approximately 12°-13° relative to said longitudinal axis.

7. The packer as claimed in claim 6, wherein the equilibrium angle of said reinforcing members in said central portion when said packer is expanded is approximately 43°-60°.

8. The packer as claimed in claim 5, wherein the equilibrium angle of said reinforcing members upon expansion of said packer is approximately the same as the lay angle of said reinforcing members at the junction of said coupling member.

9. The packer as claimed in claim 1, wherein said reinforcing members comprise cords substantially parallel with each other wrapped in a layer.

10. The packer as claimed in claim 9, wherein said reinforcing elements comprise a plurality of said layers of reinforcing members separated by adhesive material.

11. In an inflatable packer having an elastomeric tubular body having an unexpanded state and adapted for radial expansion to an expanded state and including a longitudinal axis, an elastic outer cover surrounding said tubular body, coupling members disposed on each end of said tubular body, and a plurality of reinforcing elements wound about said tubular body between said tubular body and said cover, said reinforcing elements having end portions terminating at said coupling members, said tubular body and cover having a center portion adapted for substantial uniform radial expansion and transition portions of graduated radial expansion on each side of said center portion extending between said center portion and said coupling members, the improvement wherein said reinforcing elements comprise cord members spirally wound about said tubular body with a variable lay angle relative to the longitudinal axis, and wherein said cord member lay angle continuously decreases relative to said longitudinal axis as said cord member progresses across said transition portion from each coupling member toward said center portion, said cord member lay angle decreasing across each said transition portion when said tubular body is in its unexpanded state, and said cord member lay angle enabling the formation of a substantially uniform equilibrium angle between said reinforcing cord members and the longitudinal axis throughout the entire length of said tubular body between said coupling members when said tubular body is in its expanded state.

12. The improvement as claimed in claim 11 wherein the lay angle of said cord members at their junction with said coupling members is substantially equal to the equilibrium angle of said cord members in said center portion during packer inflation.

13. The improvement as claimed in claim 12 wherein the lay angle of said cord members decreases across each said transition portion at a rate effective to create a substantially uniform equilibrium angle for said cord members throughout the entire length of said tubular body between said coupling members upon inflation of said packer and radial expansion of said tubular body.

14. The improvement of claim 13, wherein the differential between the lay angle of said cord members at said center portion and the equilibrium angle of said cord members at expansion is increased in direct proportion to the amount of radial expansion capability of said center portion.

15. The improvement of claim 13, wherein the differential between the lay angle of said cord members at said center portion and the equilibrium angle of said cord members upon packer inflation is increased in direct proportion to reduction in hoop tension capacity of said reinforcing elements at said center portion.

16. The improvement of claim 11, wherein the maximum lay angle of said cord members at the junction of said coupling members is approximately 70° relative to said longitudinal axis, and the minimum lay angle of said cord members at said center portion of said tubular body is approximately 10° relative to said longitudinal axis.

17. The improvement of claim 11, wherein the lay angle of said cord members decreases geometrically at a rate based on the second order derivative of the cord angle per inch of length of said tubular body across said transition portion.

18. The improvement of claim 11, wherein said cord members are aligned substantially parallel with each other wrapped in a layer about said tubular member.

19. The improvement of claim 18, wherein said reinforcing elements comprise a plurality of said layers of cord members separated by adhesive material.

20. An inflatable packer comprising:

an elastomeric tubular body having an unexpanded state and adapted for radial expansion to an expanded state and having a longitudinal axis;

an elastomeric outer cover surrounding said tubular body;

end flanges disposed on each end of said tubular body; and a plurality of reinforcement cords disposed between said body and said cover and having end portions terminating at said end flanges, said cords being spirally wound about said body to facilitate expansion of said body at the center portion thereof and transition of said body to a non-expansion geometry proximate said end flanges, said reinforcement cords forming a lay angle relative to the longitudinal axis, the lay angle of said cords relative to said longitudinal axis varying between said flanges and said center portion when said body is in its unexpanded state and enabling the formation of a substantially uniform equilibrium angle across the full length of said tube when in its expanded state, thereby limiting axial forces against said cords tending to separate said cords from said end flanges.

21. The packer as claimed in claim 20, wherein said lay angle varies between a maximum of 70° relative to said longitudinal axis at the intersection of said flange and cord, and 10° minimum relative to said longitudinal axis at the center portion of said tube.

22. The packer as claimed in claim 20, wherein the lay angle of said cords at the intersection of said end flanges is approximately 50°-51° relative to said longitudinal axis, and the lay angle of said cords in the center portion of said tubular body is approximately 12°-13° relative to said longitudinal axis.

23. The packer as claimed in claim 20, wherein the equilibrium angle of said cords is substantially equal to the lay angle of said cords at the intersection with said end flanges.

24. In an inflatable packer having an elastomeric tubular body having an unexpanded state and adapted for radial expansion to an expanded state and including a longitudinal axis, an elastic outer cover surrounding said tubular body, end flanges disposed on each end of said tubular body, and a plurality of reinforcing elements wound about said tubular body in between said tubular body and said cover, said reinforcing elements forming a lay angle relative to the longitudinal axis, said reinforcing elements having end portions terminating at said end flanges, the improvement comprising said reinforcing elements in the form of reinforcement cords having a variable decreasing lay angle between said end flanges and the center portion of said tubular body when said tubular body is in its unexpanded state and enabling the formation of a substantially uniform equilibrium angle between said reinforcement cords and the longitudinal axis across the length of said tubular body when said packer and said tubular body is expanded to its fully expanded state.

25. The improvement of claim 24, wherein the lay angle of said reinforcement cords decreases geometrically at a rate based on the second order derivative of the cord angle per inch per length of tubular body as said cord advances from said end flange toward the center portion of said tubular body.

26. The improvement of claim 25, wherein the equilibrium angle of said reinforcement cords at full expansion of said packer is substantially the same as the lay angle of said cords at the intersection of said cords and said end flanges.

* * * * *